US006336237B1

(12) United States Patent
Schmid

(10) Patent No.: US 6,336,237 B1
(45) Date of Patent: Jan. 8, 2002

(54) MATTRESS WITH CONDITIONED AIRFLOW

(75) Inventor: William Schmid, Plymouth, MN (US)

(73) Assignee: Halo Innovations, Inc., Plymouth, MN (US)

( * ) Notice: Subject to any disclaimer, the term of this patent is extended or adjusted under 35 U.S.C. 154(b) by 0 days.

(21) Appl. No.: 09/569,224

(22) Filed: May 11, 2000

(51) Int. Cl.[7] ..... A47C 21/04
(52) U.S. Cl. ..... 5/726; 5/423; 5/732
(58) Field of Search ..... 5/284, 423, 424, 5/726, 652.2, 732, 946, 638, 641; 128/202.18

(56) References Cited

U.S. PATENT DOCUMENTS

| | | | | | |
|---|---|---|---|---|---|
| 206,890 | A | | 8/1878 | Squires | |
| 2,025,659 | A | * | 12/1935 | Gilquin | 128/202.18 |
| 2,493,067 | A | * | 1/1950 | Goldsmith | 5/726 |
| 2,512,559 | A | | 6/1950 | Williams | |
| 3,089,153 | A | | 5/1963 | Bosc | |
| 3,266,064 | A | * | 8/1966 | Figman | 5/641 |
| 3,486,177 | A | | 12/1969 | Marschack | |
| 3,681,797 | A | | 8/1972 | Messner | |
| 4,134,167 | A | | 1/1979 | Kazuo | |
| 4,286,344 | A | * | 9/1981 | Ikeda | 4/425 |
| 4,391,009 | A | | 7/1983 | Schild et al. | |
| 5,010,611 | A | | 4/1991 | Mallett | |
| 5,305,483 | A | | 4/1994 | Watkins | |
| 5,317,767 | A | | 6/1994 | Hargest et al. | |
| 5,483,711 | A | | 1/1996 | Hargest et al. | |
| 5,675,852 | A | | 10/1997 | Watkins | |
| 5,887,304 | A | * | 3/1999 | Von Der Heyde | 5/726 |
| 6,052,853 | A | * | 4/2000 | Schmid | 5/726 |
| 6,176,236 | B1 | * | 1/2001 | Tebbe | 128/202.18 |

* cited by examiner

*Primary Examiner*—Michael F. Trettel
(74) *Attorney, Agent, or Firm*—Merchant & Gould PC

(57) ABSTRACT

Airflow through a piece of furniture, such as a ventilated mattress of an infant sleep system, is conditioned. When applied to an infant sleep mattress, the conditioning improves the infant's sleep environment to promote the infant's health and/or enhance sleep. The conditioning can include the distribution of beneficial gases, vapor, heat, or other conditioning elements into the airflow. The conditioning can also include filtration of the airflow.

16 Claims, 3 Drawing Sheets

MATTRESS WITH CONDITIONED AIRFLOW

FIELD

The invention relates to furniture, and more particularly to ventilated furniture in which an airflow is produced through the furniture for the benefit of an individual sitting, standing, lying on or otherwise occupying the furniture. One preferred application of the invention is for a ventilated mattress used in infant bedding.

BACKGROUND

Accumulation of carbon dioxide in bedding is believed to be a cause or contributing factor in Sudden Infant Death Syndrome (SIDS). Many efforts have been made to produce a mattress assembly which will prevent or reduce the occurrence of SIDS. Included among these approaches is the use of a ventilated mattress in which an airflow is created through the mattress to dissipate carbon dioxide accumulation adjacent the infant's nose and mouth.

It is believed that ventilated mattresses, as well as other ventilated furniture such as chairs, sofas, loveseats, etc., would have benefits for individuals other than infants, including bed-ridden individuals who often suffer from bed sores.

It would be advantageous to further enhance the beneficial properties of ventilated furniture, particularly a ventilated mattress for an infant sleep system.

SUMMARY

The provision of airflow through a piece of furniture affects the environment immediately adjacent the occupant (s) of the piece of furniture. Thus, the airflow provides an opportunity to alter the environmental conditions of the air space around the occupant(s) and provide a variety of benefits to the occupant(s).

In one specific application, the airflow through a ventilated mattress of an infant sleep system is conditioned, thereby improving the infant's sleep environment to promote the infant's health or enhance sleep. The conditioning can include the distribution of beneficial gases, vapor, heat, or other conditioning elements into the airflow before it flows to the infant. The conditioning can also include filtration of the airflow.

In one version of the invention, as claimed, a furniture piece comprises a base defining an interior space, and a cover disposed on the base and covering the interior space to form, along with the base, a plenum. The cover includes a plurality of apertures that place the plenum in flow communication with an exterior of the furniture piece. In addition, a fan is mounted on the base, with the fan being configured to draw air into the plenum and create an airflow from the plenum through the apertures of the cover. The furniture piece also includes means for conditioning the air that is drawn into the plenum by the fan, with the means for conditioning being disposed downstream of the fan.

In another aspect of the invention, as claimed, a mattress assembly comprises a base including a bottom and side walls, with the bottom and side walls defining an interior space. A cover is disposed on the base and covers the interior space to form, along with the base, a plenum. The cover includes a plurality of apertures that place the plenum in flow communication with an exterior of the mattress assembly. In addition, the invention includes a fan that is configured to force air into the plenum and create an airflow from the plenum through the apertures of the cover, and a filter for filtering the air forced by the fan into the plenum.

In another aspect as claimed, a mattress assembly comprises a base including a bottom and side walls, with the bottom and side walls defining an interior space. A cover is disposed on the base and covers the interior space to form, along with the base, a plenum. The cover includes a plurality of apertures that place the plenum in flow communication with an exterior of the mattress assembly. The invention also includes a fan mounted on the base, with the fan being configured to draw air into the base and into the plenum and create an airflow from the plenum through the apertures of the cover, and conditioning apparatus mounted on the base and disposed downstream of the fan for conditioning the air drawn into the base by the fan.

In yet another aspect of the invention as claimed, a mattress assembly comprises a base defining an interior space, and an apertured sleep surface is disposed on the base and covers the interior space to form, along with the base, a plenum. The apertured sleep surface is oriented generally in a plane and includes a plurality of apertures extending therethrough that place the plenum in flow communication with an exterior of the mattress. A fan is configured to force air into the plenum and create an airflow from the plenum through the apertures of the apertured sleep surface. Further, a filter layer is disposed adjacent the apertured sleep surface and is oriented in a plane generally parallel to the plane of the apertured sleep surface.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION

As used herein "furniture piece" is meant to encompass a mattress, a chair, a sofa, a loveseat and other types of furniture upon which an individual sits, stands, lays on or otherwise occupies.

It is contemplated by the inventor that the invention described herein is particularly useful with respect to infant bedding and the reduction of SIDS, and the invention will be specifically described with respect to infant bedding. However, it is also contemplated that the invention has other useful applications such as on adult bedding, as well as on other furniture items.

Figure 1:
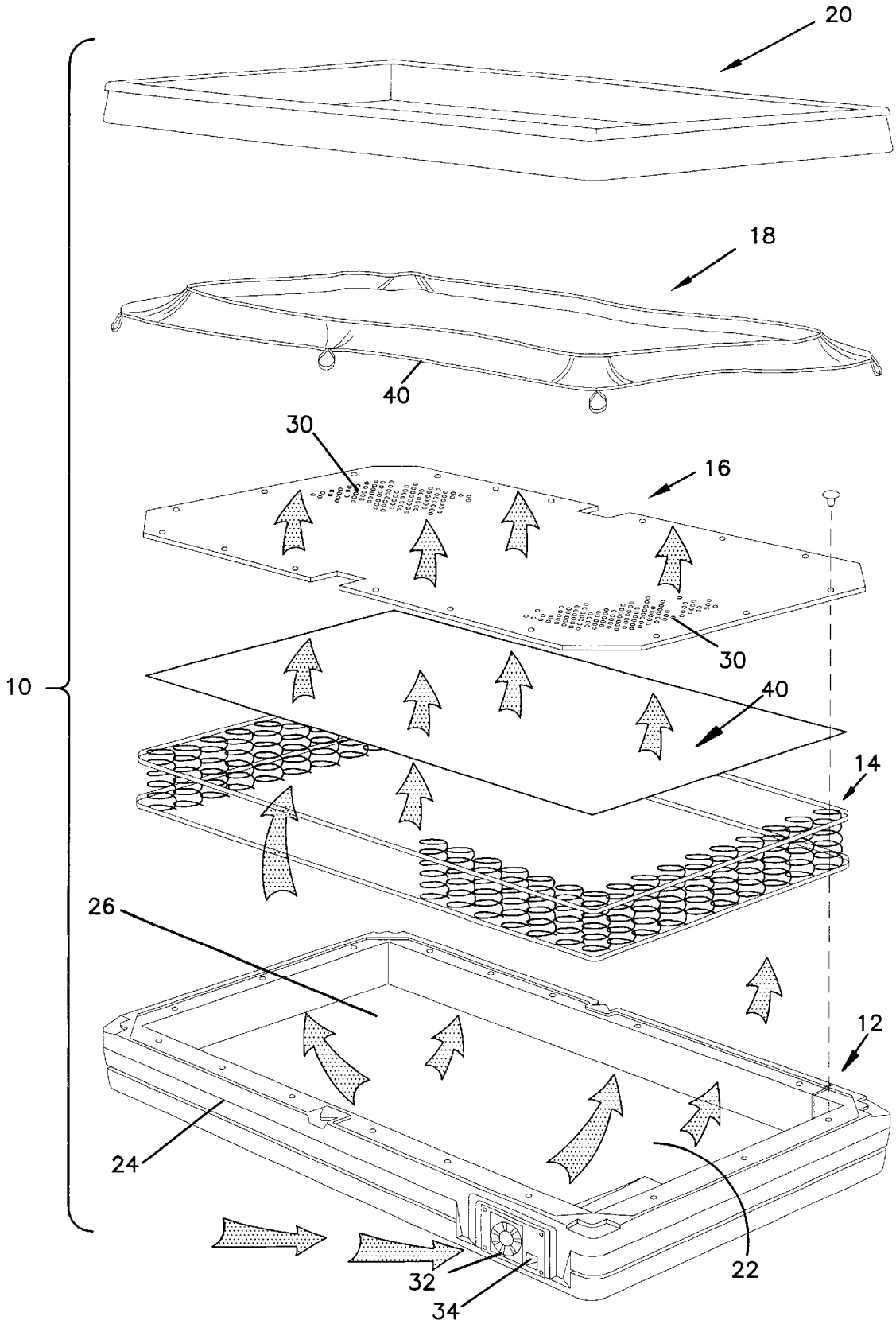
FIG. 1 is an exploded view of a mattress assembly in accordance with the principles of the invention.

One specific implementation of a mattress assembly 10 according to the invention is illustrated in FIG. 1. The mattress assembly 10 includes a base 12, an inner spring 14, an apertured cover 16, bedding 18 and a bumper assembly 20.

Figure 3:
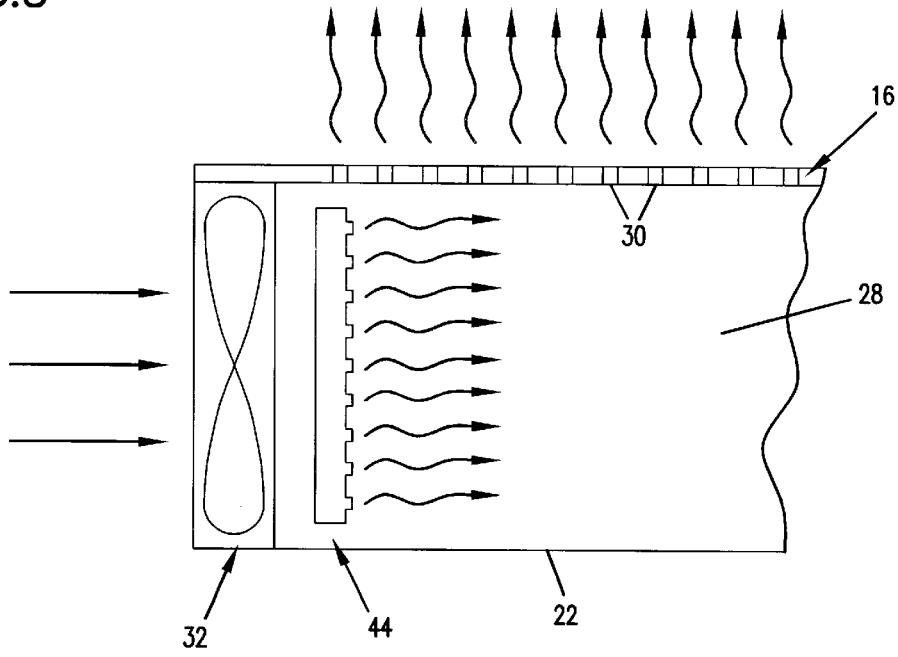
FIG. 3 is a partial cross-sectional view taken along line 3—3 of FIG. 2.
Figure 2:
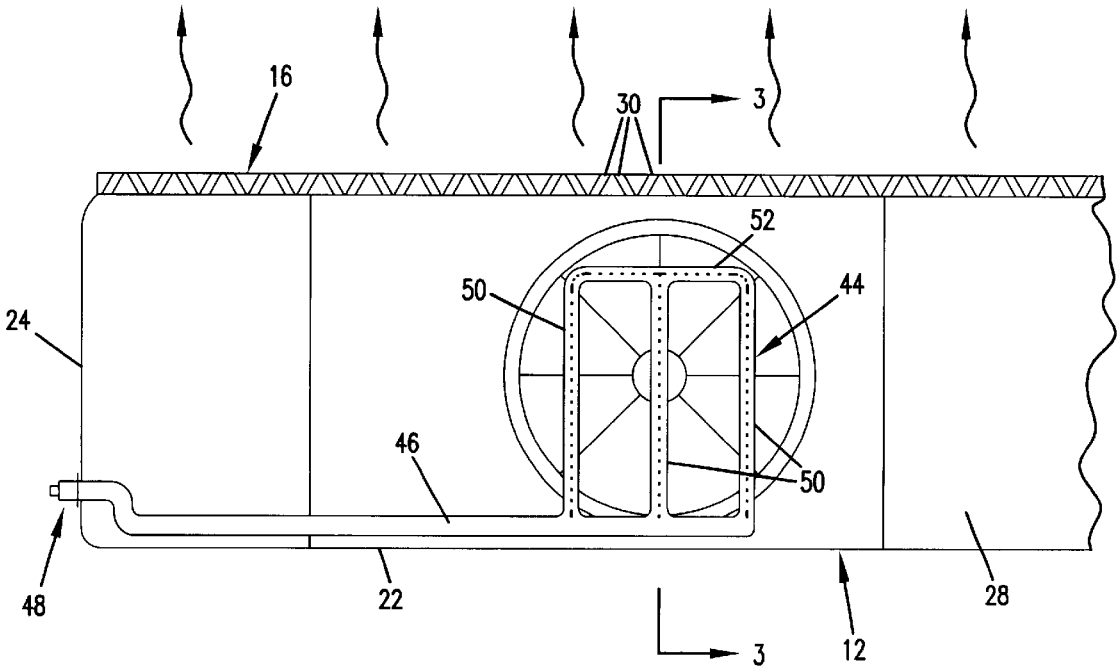
FIG. 2 is a partial sectional view illustrating the manifold downstream of the fan.

The base 12 includes a bottom wall 22 and side walls 24 extending upward from the bottom wall 22 and defining therewith an open space 26. The inner spring 14 is designed to fit in the open space 26, and the apertured cover 16 attaches to the base 12 and covers the interior space 26 to form, with the base 12, a plenum 28 (see FIGS. 2 and 3). The apertured cover 16 forms a sleep surface upon which an infant or other individual(s) sleeps. The bedding 18 fits over the cover 16 and connects to the base 12, and the bumper assembly 20 rests on the base 12. As seen in FIGS. 1–3, the apertured cover 16 includes a plurality of apertures 30 thereby placing the interior space 26 and the plenum 28 in flow communication with the exterior of the mattress assembly 10. A low voltage fan 32 is positioned in one of the side walls 24 of the base 12, and has a child resistant switch 34 for operation thereof.

Further details of the base 12, inner spring 14, apertured cover 16, bedding 18 and bumper 20 can be found in applicants co-pending application Ser. No. 08/782,249, which is herein incorporated by reference in its entirety.

The mattress assembly 10 further includes a filter 40 comprising a layer of a filter media disposed directly underneath the apertured cover 16. In the preferred embodiment, the filter 40 rests on top of the inner spring 14 underneath the cover 16. The filter layer is oriented generally in a plane that is generally parallel to the plane of the cover 16, whereby the air blown upwardly through the cover 16 by the fan 32 is filtered by the filter 40 before the air exits the apertures 30 and reaches the infant or other individual on the mattress assembly 10. The filter 40 is preferably an electrostatic filter media of a type that is well known in the art. U.S. Pat. Nos. 4,344,776 and 5,846,308, amongst others, describe electrostatic filter media.

Filtering the air removes aeroallergens such as pollen, dust, dust mites, tobacco smoke, mold spores, bacteria, and other air-borne particles, thereby conditioning the air before it reaches the individual and improving the sleep environment which provides health benefits and enhances sleep. In addition to conditioning the air, the filter 40 is believed to provide sound dampening of fan noise and noise created by the inner spring 14.

It is contemplated that the mattress assembly 10 could be used without the bumper assembly 20. However, particularly beneficial results are obtained when the bumper assembly 20 and filter 40 are used together. In particular, Applicant has discovered that the presence of the bumper assembly 20 improves the filtration efficiency of the filter 40 dramatically, compared to when no bumper assembly is present. For instance, the average filtration efficiency when no bumper is present was found to be approximately 83.4%. With the bumper assembly 20 in place, the average filtration efficiency was found to be approximately 98.7%.

Figure 4:
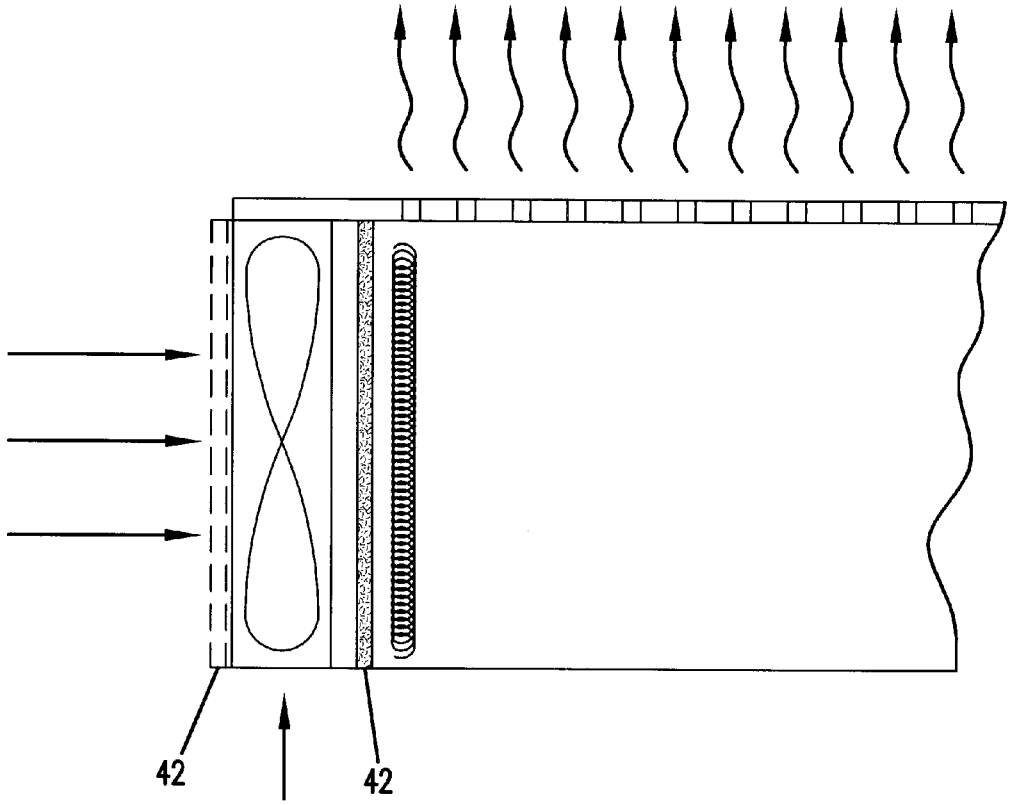
FIG. 4 is a partial cross-sectional view, similar to FIG. 3, showing possible locations for the filter.

The filter 40 is illustrated as being disposed underneath the cover 16. However, it is also contemplated that the filter 40 could be disposed on top of the cover 16 and underneath the bedding 18. Moreover, as illustrated in FIG. 4, filter media 42 could be disposed over the fan inlet or outlet, either in addition to, or more preferably in place of, the filter 40. However, placing the filter 40 either below or above the cover 16 is the preferred location, and depending upon the density of the filter media used, would not seriously impact the airflow rate from or through the cover 16.

FIGS. 2 and 3 illustrate an alternate means for conditioning the airflow, that can be used either separately from, or in combination with, the filter 40. As illustrated, a manifold 44 is secured within the base 12 downstream from the fan 32 in the fan's outlet. A supply pipe 46 runs from the manifold 44 to one of the side walls 24, and connects to a fitting 48 disposed on the exterior of the side wall 24. The fitting 48 permits connection with an external supply hose or the like in order to supply conditioning media to the manifold 44.

The conditioning media supplied to the manifold 44 through the supply hose, the fitting 48 and the supply pipe 46 includes oxygen and other beneficial gases, medications in vapor form, humidity, heat, scents such as eucalyptus and the like, and other conditioning media. A suitable control mechanism, such as a valve, will be provided on the supply hose or at the supply of condition media in order to control the supply of conditioning media.

By placing the manifold 44 downstream of the fan 32, the turbulent airflow from the fan 32 is used to uniformly distribute the conditioning media throughout the plenum 28 before it flows through the cover 16 and to the individual and the environment above the cover 16. As illustrated in FIG. 2, the manifold 44 includes a plurality of generally vertical pipes 50 and a horizontal pipe 52 interconnecting the pipes 50. The manifold 44 is disposed over a relatively large area of the fan's outlet so that the conditioning media exiting the manifold 44 is entrained in a large portion of the airflow.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A mattress assembly, comprising:

a base including a bottom and side walls, the bottom and side walls defining an interior space;

a cover disposed on the base and covering the interior space to form, along with the base, a plenum, the cover including a plurality of apertures that place the plenum in flow communication with an exterior of the mattress assembly;

a fan configured to force air into the plenum and create an airflow from the plenum through the apertures of the cover; and a filter for filtering the air it is forced by said fan into the plenum, said filter being a high efficiency filter.

2. The mattress assembly of claim 1, wherein said filter comprises a filter layer disposed underneath the cover.

3. The mattress assembly of claim 2, wherein said filter layer is oriented in a plane generally parallel to the cover.

4. The mattress assembly of claim 3, further including a bumper assembly disposed on said base.

5. The mattress assembly of claim 4, wherein the filter has a filtration efficiency of about 98.7%.

6. The mattress assembly of claim 1, wherein the filter has a filtration efficiency of at least about 83.4%.

7. A mattress assembly, comprising:

a base defining an interior space;

an apertured sleep surface disposed on the base and covering the interior space to form, along with the base, a plenum, the apertured sleep surface oriented generally in a plane and including a plurality of apertures extending therethrough that place the plenum in flow communication with an exterior of the mattress;

a fan configured to force air into the plenum and create an airflow from the plenum through the apertures of the apertured sleep surface; and an electrostatic filter layer disposed adjacent the apertured sleep surface and being oriented in a plane generally parallel to the plane of the apertured sleep surface.

8. The mattress assembly according to claim 7, further comprising a bumper assembly disposed on said base.

9. A mattress assembly, comprising:

a base including a bottom and side walls, the bottom and side walls defining an interior space;

a cover disposed on the base and covering the interior space to form, along with the base, a plenum, the cover including a plurality of apertures that place the plenum in flow communication with an exterior of the mattress assembly;

a fan configured to force air into the plenum and create an airflow from the plenum through the apertures of the cover; and an aeroallergen filter that is configured and positioned to filter allergens from the air after the air is forced by said fan into the plenum.

10. A mattress assembly, comprising:

a base defining an interior space;

an apertured sleep surface removably disposed on the base and covering the interior space to form, along with the base, a plenum, the apertured sleep surface oriented generally in a plane and including a plurality of apertures extending therethrough that place the plenum in flow communication with an exterior of the mattress;

a fan configured to force air into the plenum and create an airflow from the plenum through the apertures of the apertured sleep surface; and a filter layer disposed adjacent to the apertured sleep surface and being oriented in a plane generally parallel to the plane of the apertured sleep surface, said filter layer being non-destructively secured on the mattress assembly to permit removal of the filter layer without damaging the filter layer.

11. A mattress assembly comprising:

a base including a bottom and side walls, the bottom and side walls defining an interior space;

an apertured sleep surface removably disposed on the base and covering the interior space to form, along with the base, a plenum, the apertured sleep surface oriented generally in a plane and including a plurality of apertures extending therethrough that place the plenum in flow communication with an exterior of the mattress;

a bumper assembly removably positioned on the base;

a fan configured to force air into the plenum and create an airflow from the plenum through the apertures of the cover; and a filter layer non-destructively secured underneath the apertured sleep surface and being oriented in a plane generally parallel to the plane of the apertured sleep surface.

12. An aeroallergen filter for a ventilated mattress assembly that has a base defining an interior space, a generally planar apertured cover removably disposed on the base and covering the interior space to form, along with the base, a plenum, and a fan in flow communication with the plenum for forcing air into the plenum and creating an airflow from the plenum through the apertured cover, the filter comprising:

a planar sheet of aeroallergen filter media that is configured for non-destructive removable securement under the apertured cover in a planar orientation generally parallel to the plane of the apertured cover when the apertured cover is disposed on the base, wherein the aeroallergen filter media is constructed to remove allergens from the airflow.

13. The filter of claim 12, wherein the aeroallergen filter media is electrostatic filter media.

14. The filter of claim 12, wherein the planar sheet of aeroallergen filter media is generally rectangular.

15. The filter of claim 12, wherein the planar sheet of aeroallergen filter media is constructed so as to not seriously impact the rate of airflow through the apertured cover.

16. The filter of claim 12, wherein the aeroallergen filter media is constructed to remove pollen, dust, dust mites, tobacco smoke, mold spores and bacteria from the airflow.

* * * * *